US006825406B2

(12) United States Patent
Thidell

(10) Patent No.: US 6,825,406 B2
(45) Date of Patent: Nov. 30, 2004

(54) DEVICE FOR STRING INSTRUMENTS

(75) Inventor: Anders Thidell, Södertälje (SE)

(73) Assignee: Bre Produktion AB (SE)

( * ) Notice: Subject to any disclaimer, the term of this patent is extended or adjusted under 35 U.S.C. 154(b) by 76 days.

(21) Appl. No.: 10/257,572

(22) PCT Filed: Apr. 11, 2001

(86) PCT No.: PCT/SE01/00816

§ 371 (c)(1),
(2), (4) Date: Feb. 3, 2003

(87) PCT Pub. No.: WO01/80216

PCT Pub. Date: Apr. 25, 2001

(65) Prior Publication Data

US 2003/0188623 A1 Oct. 9, 2003

(30) Foreign Application Priority Data

Apr. 13, 2000 (SE) ..... 0001382

(51) Int. Cl.[7] ..... G10D 3/00

(52) U.S. Cl. ..... 84/313; 84/314 N; 84/312 R; 84/298

(58) Field of Search ..... 84/313, 298, 299, 84/312 R, 314 R, 314 N

(56) References Cited

U.S. PATENT DOCUMENTS

| | | | | |
|---|---|---|---|---|
| 3,437,001 A | | 4/1969 | Kraft | |
| 3,580,124 A | * | 5/1971 | Mancini | 84/313 |
| 3,599,524 A | | 8/1971 | Jones | |
| 4,080,865 A | | 3/1978 | Gfell | |
| 4,170,161 A | | 10/1979 | Kaftan | |
| 4,648,304 A | * | 3/1987 | Hoshino et al. | 84/313 |
| 4,944,208 A | * | 7/1990 | Kusek | 84/313 |

FOREIGN PATENT DOCUMENTS

GB 2105898 3/1983

* cited by examiner

*Primary Examiner*—Shih-Yung Hsieh
(74) *Attorney, Agent, or Firm*—Banner & Witcoff, Ltd.

(57) ABSTRACT

A string instrument with lengthwise tensioned strings above a fingerboard (18), where the strings are intended to be set in oscillation for tone generation and where the length of the strings' oscillating part is variable for the variation of the pitch by pressing the string against selectable positions on the fingerboard. The strings are running across a nut (16) arranged at the upper end of the fingerboard across the fingerboard. Such an instrument has a device with the nut including several nut parts (20, 22, 24 . . . ) that are arranged side-by-side across the width of the fingerboard and which are individually movable along the lengthwise direction of the fingerboard.

14 Claims, 9 Drawing Sheets

DEVICE FOR STRING INSTRUMENTS

This is a U.S. National Phase Application Under 35 USC 371 and applicant herewith claims the benefit of priority of PCT/SE01/00816, filed Apr. 11, 2001, which was published under PCT Article 21(2) in English, and application Ser. No. 0001382-1 filed on Apr. 13, 2000 in Swedish.

BACKGROUND OF THE INVENTION

The present invention relates to a device for string instruments with a fingerboard, above which the strings are tensioned lengthwise and intended to be set into oscillation for tone generation, where the length of the strings' oscillating part is variable for variation of pitch by pressing the string with a finger at selectable positions on the fingerboard, the strings running across a nut arranged at the upper end of the fingerboard across the fingerboard.

For string instruments of the above kind, difficulties exist with the accuracy of intonation across the different parts of the fingerboard. Furthermore, the strings have certain grades of stiffness, varying from one string to another, which often results in that an oscillation node does not appear exactly at the contact spot of the string against the fingerboard or fret. Particularly for new strings, this variability in stiffness creates a problem. This results in the tone being out of tune and the magnitude of the displacement of the oscillation node varies from one string to another and the location of the fingerboard and is impossible to foresee.

Certain string instruments of the aforementioned kind, for example, electric guitars and electric bases, are equipped with a mechanism at the string attachment on the bridge where one can vary the string length and thereby improve the intonation.

SUMMARY OF THE INVENTION

The purpose of the present invention is to provide a device for string instruments of the above-mentioned kind as well as such a string instrument that shows marked improvements in terms of accuracy of intonation.

This purpose is achieved with a device of the kind defined in the introductory portion having the characterizing features specified in claim 1 and with a string instrument specified in claim 13.

Because the nut includes several nut pieces that are arranged side by side over the width of the fingerboard and that are individually moveable in the lengthwise direction of the fingerboard, the distance between the contact spots of the strings on the bridge and on the nut will be adjustable allowing to improve the intonation.

According to an advantageous embodiment, an individually moveable nut piece is designed to carry each string. In this way, individual adjustment of each string is possible.

According to another advantageous embodiment of the device according to the invention, the nut pieces can be individually locked to the fingerboard by locking means, that are accessible between the strings for releasing for displacement and fixation of the nut pieces respectively. In this way, the locking means, which for example can be formed as screws, to screw the nut pieces onto the fingerboard, are easily accessible for release or fixation.

According to yet another advantageous embodiment of the invented device, a mechanism for varying the string length is mounted at the string attachment adjacent to the bridge. Through the co-operation between this mechanism and the moveable nut pieces, the whole oscillating part of the string can be moved lengthwise along the fingerboard, which makes it possible to obtain optimum intonation.

According to other advantageous embodiments of the invented device, said mechanism includes a swaying bridge with a holder within the instrument body, in which a rotating shaft is placed that is permeated by threaded screws, the lengths of which exceed the diameter of the shaft, and thus the screws extend beyond the shaft a certain distance, the strings being intended to be attached to the end of the projecting parts of the screws, which allows shifting of the pitch by turning of the threaded shaft. The length of the projecting part of the threaded screws is adjustable by turning the screw in the shaft. In this way, it is possible to achieve swaying and key changes in a simple way. Furthermore, it is possible to achieve swaying and key changes while preserving the tuning and the intonation. Strings at different diameters demand different amounts of slackening and tensioning for e.g. a half-note change, and as the projecting part of the screws are adjustable, the length of the projection can be adjusted to the size of the required change of the string length. A thin string demands more of slackening or tensioning than a thicker one.

According to yet another advantageous embodiment of the invented device, the rotating shaft is springs biased opposite to the direction that the strings normally strive to turn the shaft. In this way the tension from the strings will be balanced and allow for smooth turning of the shaft for swaying or key changes.

According to still another advantageous embodiment of the invention, the rotating shaft is arranged below a holder plate attached to the front side of the instrument, which holds rotating pins parallel to the front side of the instrument over which the strings are intended to run. Thus, when tensioning or slackening the strings, they will run smoothly over the breakpoint at the bridge without jamming.

According to other advantageous embodiments of the invented device the swaying area can be turned and locked into predetermined turning positions, whereby the distance between two predetermined turning positions corresponds to a predetermined change of pitch of the instrument. When turning the swaying area, it can suitably be moved along sticks positioned on the front side of the instrument body, locking rings being arranged in predetermined positions to keep the swaying area in desired position. The swaying area is thus locked against a certain ring, the position of the rings being arranged so that, for instance, locking of the swaying area against a first locking ring corresponds to a pitch change of a semitone, locking against the second locking ring a pitch change of a whole tone, and so on. In this way, it is possible to make a defined change of pitch of the whole instrument while playing can continue with the same fingering.

According to advantageous embodiments of the string instrument according to the invention frets are arranged across the fingerboard, at least some of them being curved to make it possible to improve intonation of the tone intervals. Preferably, the frets can be designed so that all thirds of the instrument will be pure.

According to still another advantageous embodiment of the instrument according to the invention, the frets are designed so that 19 tones per octave are available. This means a marked improvement of the intonation in comparison to today's common tempered tuning with 12 tones per octave. Alternatively, the frets can be designed to make 31 tones per octave available. This is the perfect solution in terms of intonation.

BRIEF DESCRIPTION OF THE DRAWINGS

To explain the invention in greater detail, embodiments of the invention will now be described with reference to enclosed drawings.

DESCRIPTION OF THE INVENTION

Figure 1:
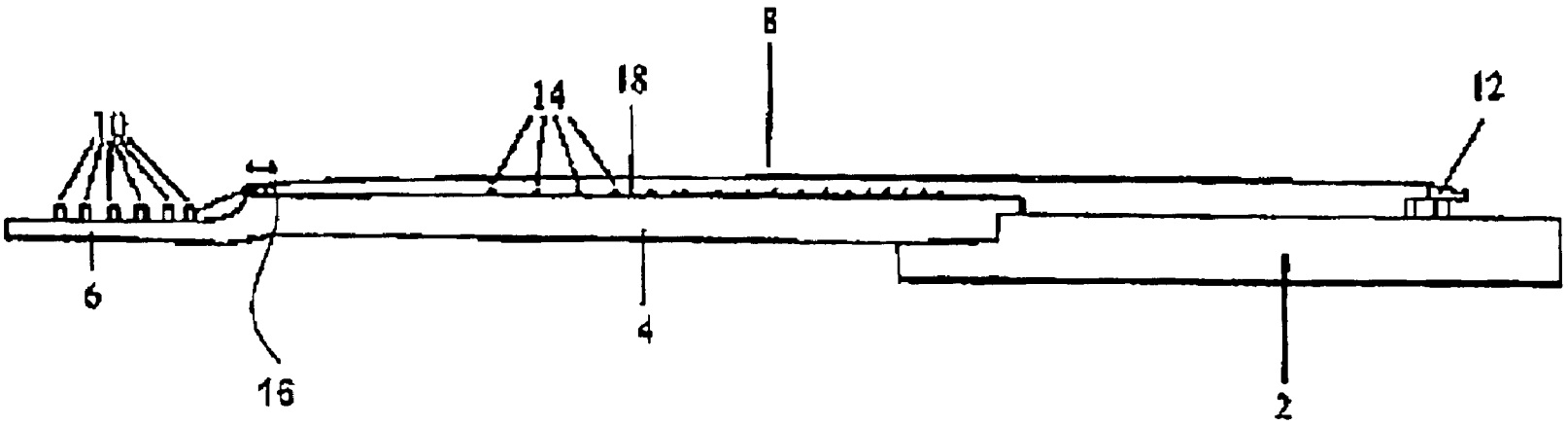
FIG. 1 is a string instrument according to the invention.

FIG. 1 illustrates in a schematic way an example of a string instrument, e.g. a guitar, with the device according to the invention. The instrument includes a body 2, an oblong neck 4 and also a head 6. Strings 8 are tensioned between a mechanic string holding means 10 in the head 6 on the front side of the neck 4 lengthwise to a string attachment at the bridge 12 on the body 2. The neck 4 is provided with a fingerboard with transverse frets 14 that define the length of the oscillating part of the string between the specific fret 14, against which the string is pressed by the player's finger, and the bridge 12. The mechanic means 10 normally contains a screw mechanism for tuning the instrument by increasing or decreasing the tension of the specific string. At the upper end of the neck 4, the fingerboard is terminated by a nut 16 across which the strings 8 are running.

Figure 2:
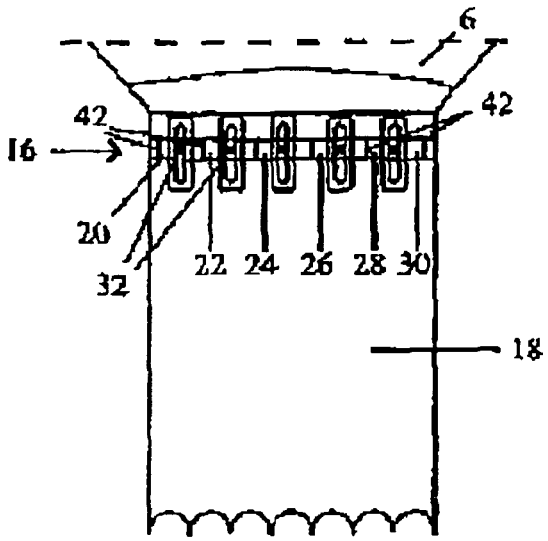
FIG. 2 shows the upper part of the instrument's neck from the front side of the fingerboard.
Figure 3:
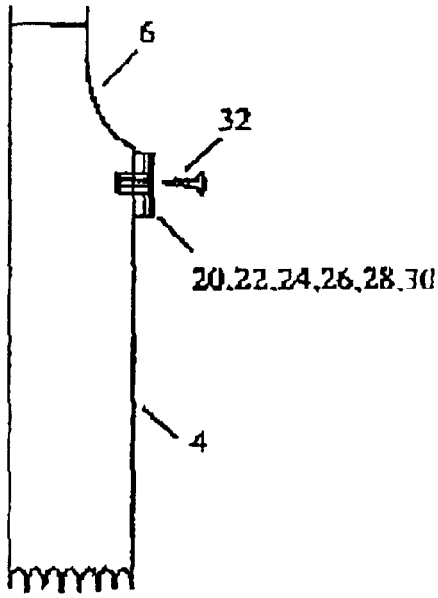
FIG. 3 shows a lateral view in cross section of the upper part of the fingerboard.
Figure 4:
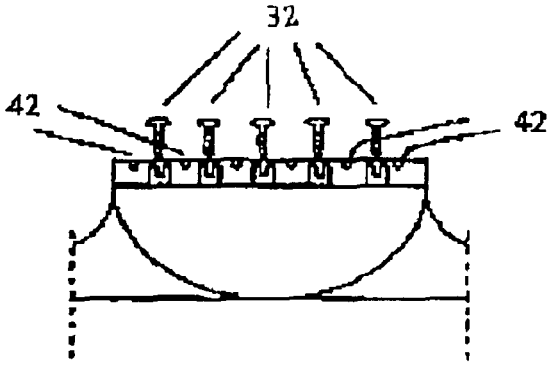
FIG. 4 shows a cross section through the instrument's neck at the location of the nut.

FIG. 2 shows the upper part of the fingerboard 18 with an example of the device according to the invention in the form of the nut 16 with several nut pieces 20, 22, 24, 26, 28, 30 arranged side by side across the width of the fingerboard 18, preferably made of brass. The nut pieces 20, 22, 24, 26, 28, 30 are individually moveable lengthwise along the fingerboard 18 and can be fixed to the fingerboard with suitable locking means, for example screws 32, see also FIGS. 3–5. Other kinds of locking means may also be used, of course. The nut pieces 20, 22, 24, 26, 28, 30 are designed so that neighbouring nut pieces overlap each other, such that an upper part 34 of a nut piece 20 is guided on a lower part 36 of the nearby located nut piece 22, see FIGS. 4 and 5. In pieces 34 and 36, there are superposed lengthwise slots 38, 40, through which a locking screw 32 is run to fix the nut piece(s) in the desired position on the fingerboard.

In each of the nut pieces 20, 22, 24, 26, 28, 30 is a slot 42 where the string is intended to run.

Figure 5:
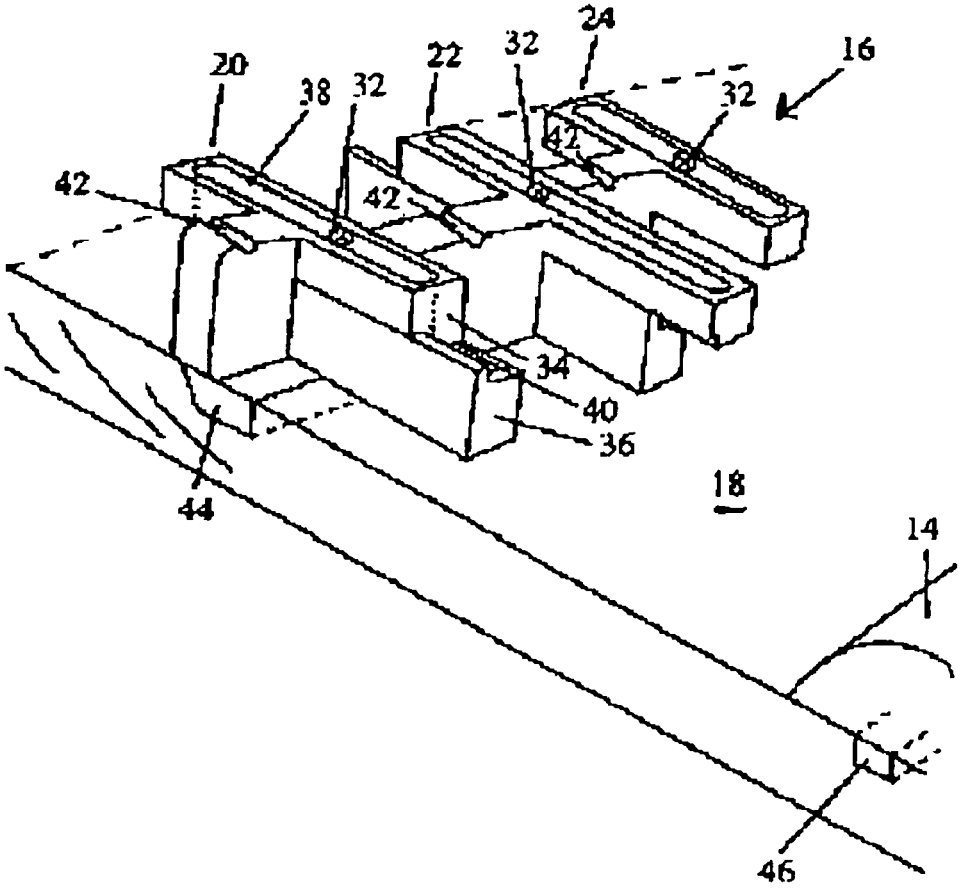
FIG. 5 shows an enlarged view of a part of the adjustable nut in a perspective view from the front side of the fingerboard.

The entire nut construction is mounted on the fingerboard 18 with a fastening device 44 laid in a slot running across the neck in a way analogous to how the frets 14 are attached with fastening elements 46 in slots in the fingerboard 18 (see FIG. 5). This fastening element will be preferably a brass inset onto which the nut pieces are screwed.

To adjust the outermost nut piece 20 in FIG. 5, one loosens the screw 32, whereupon the nut piece 20 can be moved and locked in a desired position by way of tightening the screw 32. To move the next nut piece 22, its locking screw 32, as well as the previous one 32, needs to be loosened due to the overlap construction of the nut piece 22, see FIG. 4. Thereafter the nut piece 22 can be moved to its desired position and the two screws can be tightened to lock the nut piece. In the same way, both the locking screw 32 on nut piece 24 and the neighbouring locking screw 32 must be loosened when one wishes to move the nut piece 24. However, to move the second outermost nut piece 30, not shown in FIG. 5, only one locking screw needs to be loosened in the same way as with nut piece 42, see FIG. 2.

In this way, the nut pieces can be placed in individually desired positions and the contact point 42 for each particular string can be individually adjusted. This allows for important improvements in intonation. When a nut piece is moved "upwards" in the direction of the head of the instrument, the tone rises, and when the nut piece is moved in the opposite direction, the tone is lowered. Because the strings often vary in stiffness, the node of the oscillating part is often not positioned exactly on the particular fret 14 against which it is pressed during playing but somewhere slightly to the side of the fret, which results in an false tone. Such defective intonation can be corrected by suitable displacement of the nut piece for the string in question.

Figure 6:
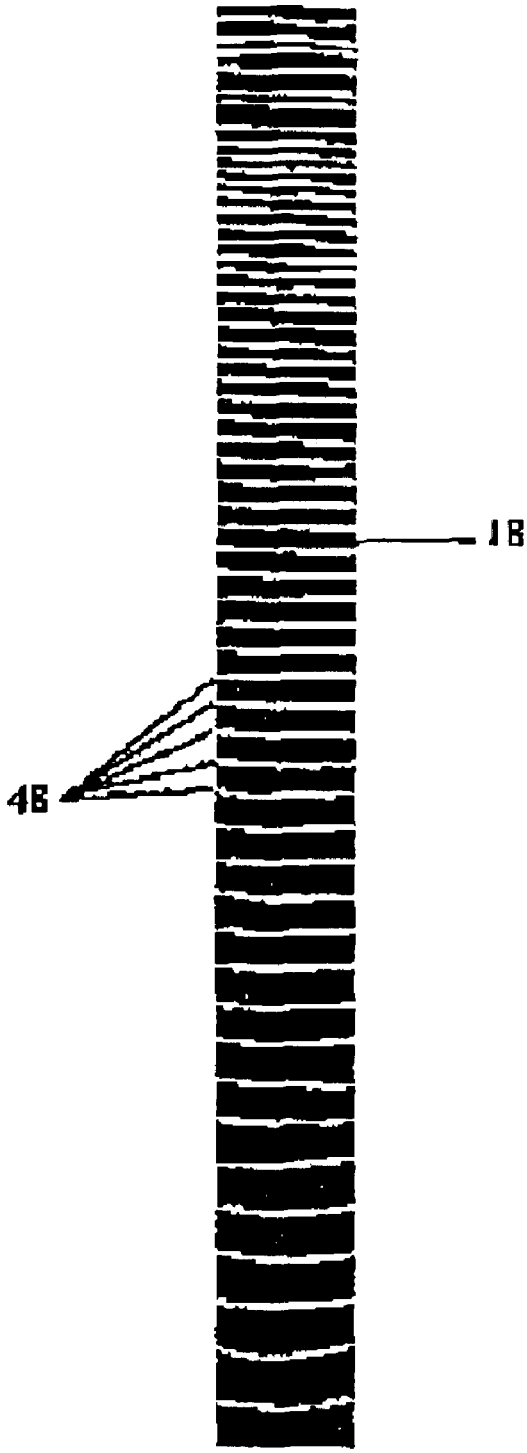
FIG. 6 shows as an example a part of the fingerboard of a string instrument according to the invention with curved frets, FIG. 7 in a view from above, shows the body and a part of the neck of a string instrument according to the invention and equipped with a swaying bridge and a key shift.

The uniform tempering normally used in western music, with division of the octave into 12 semitones, is a compromise that leads to imperfect intonation. One way to reduce this problem is to arrange suitably curved frets in the fingerboard. The frets can be curved in a way that, for example, all thirds of the instrument become pure. The octave will then contain 19 tones, which results in a considerable improvement compared to today's compromise with 12 tones, uniform tempering. The most perfect solution of this problem is to design the frets so that 31 tones are available within the octave. FIG. 6 shows a part of a fingerboard provided with such frets 48.

Certain string instruments, primarily electric guitars and electric bases, have a mechanism at the string attachment to the bridge in order to tune the instrument or to provide swaying effects by varying the length of the string. Such mechanisms in conventional design usually consist of a plate with a folded edge. On the plate there is a saddle, screwed firmly into the folded edge, which serves as a support for the head of the screw. By turning the screw, the saddle is moved towards or away from the neck of the instrument and to vary the length of the string.

If one uses this mechanism in conjunction with the saddle construction described above, one thus can move the whole oscillating string part between bridge and nut relative to the neck and body. This gives new and favourable possibilities for intonation of the instrument by so-called balanced intonation, and with the invented device combined with the conventional tuning mechanism, optimal intonation can be achieved.

Figure 7:
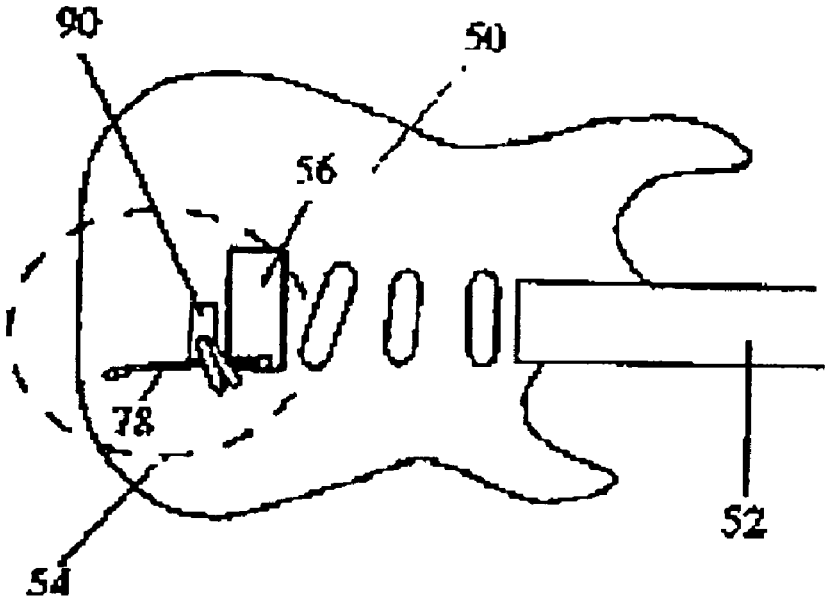

FIG. 7 shows from above the body 50 and a part of the neck 52 of a string instrument according to the invention, provided with a swaying bridge and key shift 54.

Figure 8:
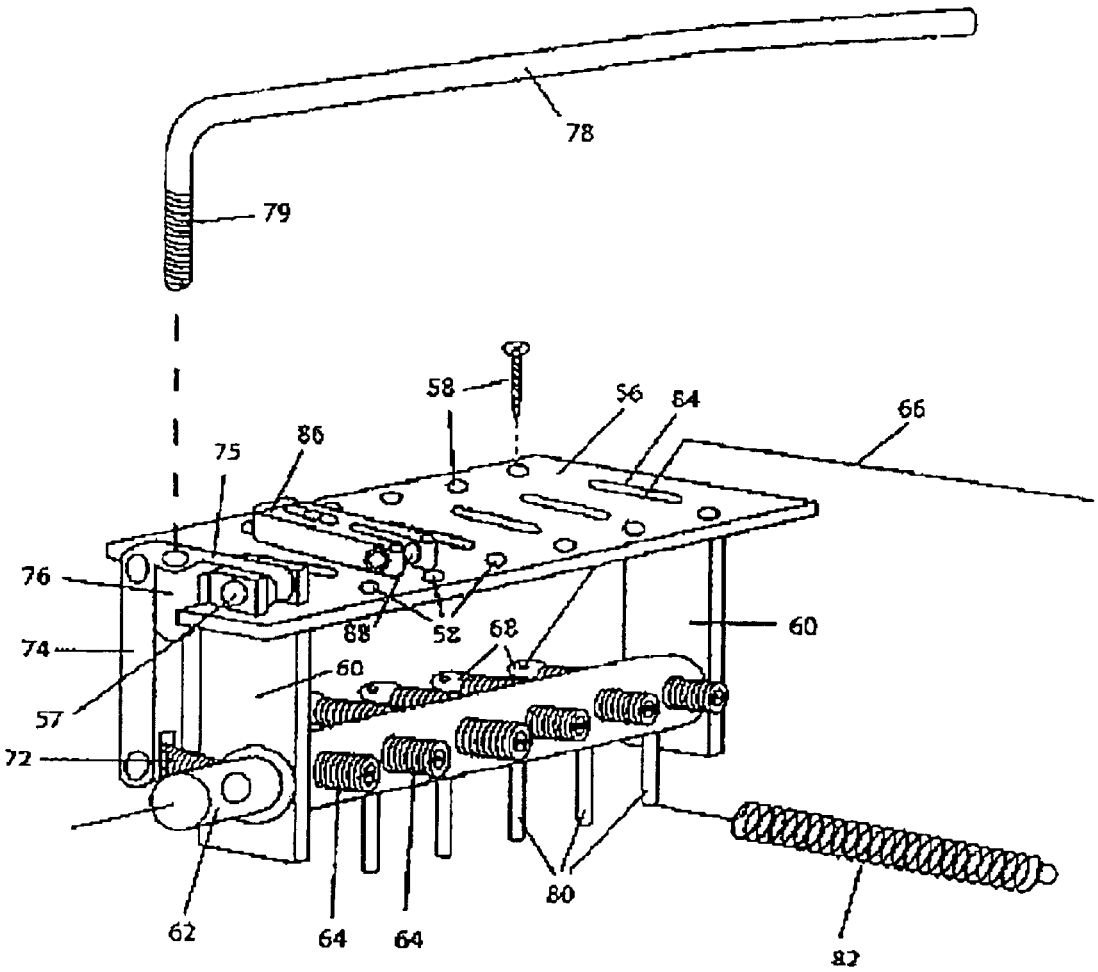
FIG. 8 shows an embodiment of the swaying bridge of the device according to the invention.

FIG. 8 shows the swaying bridge in greater detail. The swaying bridge includes a holder with a holder plate 56 intended to be fastened by screws at 58 at the front side of the instrument body. At right angles to the plate 56, two gables 60 extend, through which a rotating shaft 62 is running.

Through the shaft 62, threaded screws 64 extend, one for each string 66. To simplify the picture, only one string is shown. These screws 64 have, at least on one side of the shaft 62, an projecting part 68 in which the strings 66 are attached. The screws 64 are, as mentioned, screwed into holes that run through the shaft 62, and thus the length of the projecting part 68 can be varied by turning the screws 64. This is an essential advantage of the construction because strings of different diameters require different amounts of tensioning or slackening to permit the strings to follow each other parallel in pitch at swaying or in key changes. A thin string consequently demands lager loosening or tensioning than a thicker string to achieve a certain change of pitch, which can be achieved in the invented device by making the projection 68 of the screws 64 for the different strings of different lengths.

Figure 9:
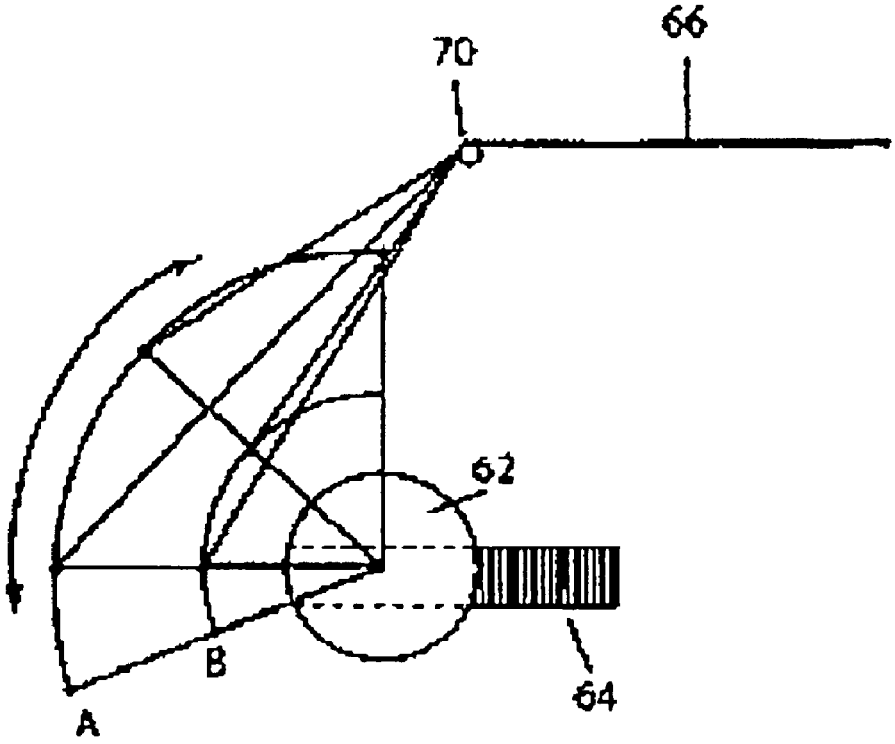
FIG. 9 illustrates the function at the swaying bridge in FIG. 8 to maintain mutual tuning between the strings when swaying and shifting key.

FIG. 9 thus shows in a schematic way the rotating shaft 62 and the screws 64. The projecting part 68 for a thin string will extend to the circle A, while the projecting part 68 for a thick string extends only to circle B. The projecting parts 68 will thus serve as swing arms when rotating the shaft 62, the motion of the string attachment for a thin string in the projecting part reaching circle A in the figure, being greater than the motion for a thicker string, which is attached to an projecting part extending only to the circle B, as shown in FIG. 9.

At 70 in FIG. 9, the breaking point for the string 66 at the bridge is shown.

The construction shown in FIG. 8 is arranged in a cavity in the body 50 of the instrument, and to allow for convenience in swaying or key changes from the front side of the instrument, the rotating shaft 62 is manoeuvrable, through an arrangement of links 72, 74, 75, with a swaying arm 78. The curved end of the swaying arm 79 is threaded, to be screwed into the hole 76 on the link arm 75, which at one end is attached in a rotating fashion to the plate 56, shown at 57 in FIGS. 8 and 10. The swaying operation is achieved by pressing the swaying arm 78 towards the body 50 of the instrument and by pulling the arm 78 away from the body 50. When the swaying arm 78 is pressed towards the body of the instrument 50, the motion of the arm 78 results in the turning of the shaft 62 through the link arrangements 72, 74, 75, and thereby also the projecting parts 68, so the instrument is tuned downwards, and when the arm is pulled in the opposite direction away from the body 50 of the instrument, the shaft is turned such that the instrument rises in tuning.

At a right angle to the turning shaft 62, there are pegs 80, and at their free end, springs 82 are attached. In FIG. 8, only one such spring 82 is shown to simplify the picture. These springs 82 strive to turn the shaft 62 in the opposite direction to which the tension of the strings strive to turn the shaft 62. In this way, the tension from the strings is balanced and the turning of the shaft 62 is facilitated.

From the attachments of the strings at the projecting parts 68, the strings 66 run through slits 84 in the plate 56. Above the slits 84, there is a guiding mechanism 86 for the strings 66. In this guiding mechanism 86, a guiding pin 88 runs through a bushing. Thus, each string 66, from its associated pin 88 in the guiding mechanism 86. In this way, one avoids the motion of the string leading to a jam at the break point of the bridge.

The swaying device described in FIG. 8 also can be used as a key shift. The loosening or tensioning of the strings 66 achieved by the turning of the swaying arm 78, as described above, also can be used to change the pitch with, for example, a half-tone. In this way, playing in another key is possible without changing the fingering.

Figure 10:
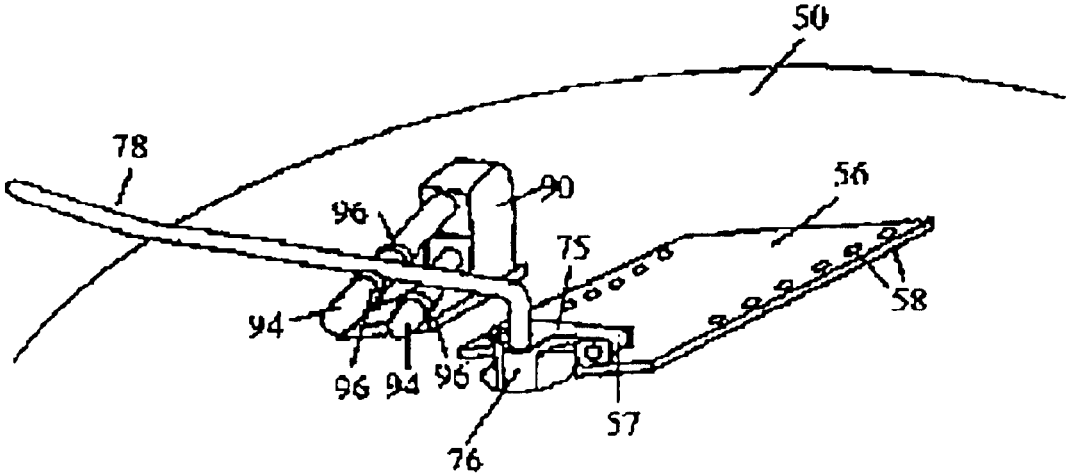
FIGS. 10 and 11 show, in two different views, a realisation of the key shift at the swaying bridge, shown in FIG. 8.
Figure 11:
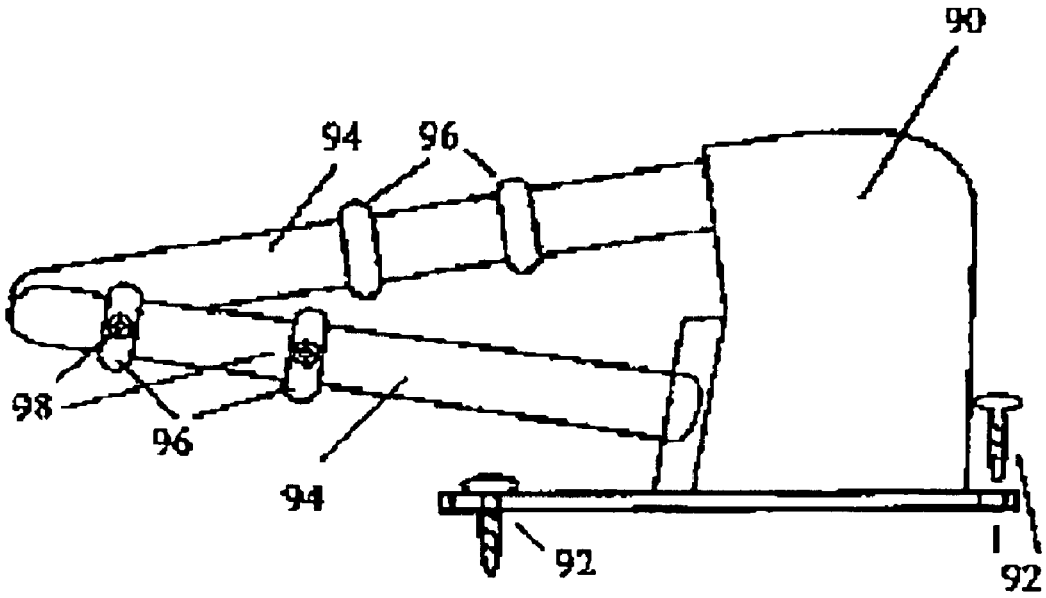

FIGS. 10 and 11 show a shift unit 90, that is attached as well to the front side of the body of the instrument 50, at 92 in FIG. 11, preferably behind the bridge. From the part 90, there are two pins 94 that are displaced in different directions and that run on an angle in relation to the front side of the body 50 of the instrument. On these pins 94, there are locking rings 96 that can be locked in desired positions with locking screws 98, see FIG. 11. The swaying arm 78 is not screwed to the bottom of the hole 76, but can, when needed, be turned to the key changing unit 90 arranged behind the bridge. When the swaying arm 78 in this position turns around the threaded end 79, it runs along these pins 94 and is be kept in certain positions by the locking rings 96. The positions of the locking rings 96 are suitably adjusted so that when the swaying arm is locked by the first locking ring 96, one achieves a change of key with a half-tone, when locked against the second locking ring 96, a key change of a whole tone, and when locked against the third locking ring 96, the pitch change is a whole tone plus a half-tone, and so on. Naturally, the locking rings also can be adjusted to provide minor pitch/key changes between successive locking rings.

What is claimed is:

1. Device for string instruments with lengthwise tensioned strings above a fingerboard, where the strings are intended to be set in oscillation for tone generation and where the length of an oscillating part of the strings is variable for the variation of the pitch by pressing the string against selectable positions on the fingerboard, the strings running across a nut mounted across an upper end of the fingerboard, said nut including several nut parts arranged side-by-side across the width of the fingerboard and individually movable along the lengthwise direction of the fingerboard, said device comprising a swaying bridge mounted at the string attachment adjacent the instrument bridge, said swaying bridge comprising a holder for being disposed in a body of the instrument in which a rotatable shaft is provided and through which threaded screws run, the length of said screws exceeding the diameter of the shaft to thus project a certain distance outside the shaft wherein the strings are to be attached to the end portion of the projecting parts of the screws to make pitch changes possible by the turning of the shaft, and a rotational mechanism is connected to the rotatable shaft, said rotational mechanism being manoeuvable by a turnable swaying arm disposed at the front side of the body of the instrument for turning the shaft, said swaying arm is lockable in predetermined turning positions, the distance between the lockable turning positions corresponding to a predefined change of the pitch of the instrument.

2. Device according to claim 1, characterized in that one individually movable nut part is adapted to carry each string.

3. Device according to claim 1, characterized in that the nut parts are can be fixed at selectable positions on the fingerboard.

4. Device according to claim 3, characterized in that the nut parts are fixed to the fingerboard with locking means, which are accessible between the strings for releasing for displacement and for fixation of the nut parts respectively.

5. Device according to claim 1, characterized in that the length of the projecting parts of the screws is adjustable by turning the threaded screws in the shaft.

6. Device according to claim 1, characterized in that the rotatable shaft is spring biased in the turning direction opposite to the direction in which the strings strive to turn the shaft.

7. Device according to claim 1, characterized in that the rotatable shaft is mounted beneath a holding plate provided at the front side of the body of the instrument, said plate carrying rotatable pins oriented parallel to the front side of the instrument.

8. Device according to claim 1, characterized in that, when turned, the swaying arm is moveable along obliquely arranged pins on the front side of the instrument, on which pins locking rings are provided in predetermined positions to retain the swaying arm in desired turning position.

9. String instrument comprising strings tensioned above a fingerboard in its longitudinal direction, said strings to be oscillated for tone generation and the length of oscillating part of the strings being variable for the variation of the pitch by pressing the string against selectable positions of the fingerboard, said strings running across a nut arranged at the upper end of the fingerboard across the fingerboard, a device comprising a swaying bridge mounted at the string attachment adjacent the instrument bridge, said swaying bridge comprising a holder disposed in a body of the instrument in which a rotatable shaft is provided and through which threaded screws run, the length of said screws exceeding the diameter of the shaft to thus project a certain distance outside the shaft, wherein the strings are to be attached to the end portion of the projecting parts of the screws to make pitch changes possible by the turning of the shaft, and a rotational mechanism is connected to the rotatable shaft, said rotational mechanism being manoeuvable by a turnable swaying arm disposed at the front side of the body of the instrument for turning the shaft, said swaying arm is lockable in predetermined turning positions, the distance between the lockable turning positions corresponding to a predefined change of the pitch of the instrument.

10. Instrument according to claim 9, characterized in that frets are arranged across the fingerboard.

11. Instrument according to claim 10, characterized in that at least some of the frets have a curved design across the fingerboard to enable improvement of the intonation of the tone intervals.

12. Instrument according to claim 11, characterized in that the frets are designed so that all the thirds of the instrument are pure.

13. Instrument according to claim 10, characterized in that the frets are designed so that 19 tones are accessible within the octave.

14. Instrument according to claim 10, characterized in that the frets are designed so that 31 tones are accessible within the octave.

* * * * *

UNITED STATES PATENT AND TRADEMARK OFFICE

CERTIFICATE OF CORRECTION

PATENT NO. : 6,825,406 B2
DATED : November 30, 2004
INVENTOR(S) : Anders Thidell It is certified that error appears in the above-identified patent and that said Letters Patent is hereby corrected as shown below:

Title page,
Item [87], PCT Publication Data,
replace "Apr. 25, 2001" with -- Oct. 25, 2001 --.

Column 6,
Line 55, delete "can be".

Signed and Sealed this

Twenty-first Day of February, 2006

JON W. DUDAS
*Director of the United States Patent and Trademark Office*